United States Patent [19]

Tinney

[11] 4,085,773

[45] Apr. 25, 1978

[54] WATER HEATER OVERFLOW PAN

[76] Inventor: Lyle D. Tinney, R.R. 1, Box 114, Leesburg, Fla. 32748

[21] Appl. No.: 729,961

[22] Filed: Oct. 6, 1976

Related U.S. Application Data

[63] Continuation-in-part of Ser. No. 696,566, Jun. 16, 1976.

[51] Int. Cl.[2] ..... F17D 1/00

[52] U.S. Cl. ..... 137/571; 137/590; 122/510; 220/1 C; 220/DIG. 14; 220/DIG. 22

[58] Field of Search ..... D30/16; D7/23; D23/88, D23/89, 120; 122/504, 510; 220/1 C, 70, DIG. 5, DIG. 6, DIG. 14, DIG. 22; 248/350; 137/571, 590

[56] References Cited

U.S. PATENT DOCUMENTS

| | | | |
|---|---|---|---|
| 2,724,401 | 11/1955 | Page | 122/504 |
| 2,995,201 | 8/1961 | Stafford | 122/504 |
| 3,063,432 | 11/1962 | Bond et al. | 122/504 |
| 3,069,671 | 12/1962 | Taylor | 122/504 |
| 3,143,243 | 8/1964 | Nackusick | 248/350 |
| 3,405,685 | 10/1968 | Harrell | D30/16 |
| 3,430,803 | 3/1969 | Nelson | D7/23 |
| 3,473,553 | 10/1969 | Collins | 122/504 |
| 3,486,523 | 12/1969 | Mullings | 137/590 |
| 3,622,036 | 11/1971 | Bongaerts | 220/70 |
| 4,008,757 | 2/1977 | Weatherford, Jr. | 122/510 |

FOREIGN PATENT DOCUMENTS

| | | | |
|---|---|---|---|
| 802,806 | 1/1951 | Germany | 220/DIG. 6 |
| 599,766 | 3/1948 | United Kingdom | 220/DIG. 6 |
| 1,339,928 | 12/1973 | United Kingdom | 220/1 C |

*Primary Examiner*—Martin P. Schwadron
*Assistant Examiner*—H. Jay Spiegel
*Attorney, Agent, or Firm*—Robert F. Ruemeli

[57] ABSTRACT

An overflow unit for a water heater installation has a plastic, resilient polystyrene pan with a bottom wall for receiving the bottom of the heater and a continuous side wall including inner and outer walls which diverge downwardly in a range of approximately five to fifteen degrees. A bottom edge portion of the outer wall is substantially coplanar with the bottom or outer face of the bottom wall but, preferably, extends outwardly a distance up to approximately 0.0001 inch from the outer face of the bottom wall when the pan is in a relaxed condition. Upon being placed on a supporting surface and receiving the water heater, the bottom edge portion of the outer wall is snugly and closely seated on the supporting surface. A drain coupling for receiving a drain line opens through the inner and outer walls and is in sealed engagement with the inner wall.

6 Claims, 2 Drawing Figures

WATER HEATER OVERFLOW PAN

This application is a continuation-in-part of my copending United States patent application Ser. No. 696,566, filed June 16, 1976.

This invention relates to an overflow pan for a water heater and, more particularly, to a plastic pan having a bottom wall, and a continuous side wall including inner and outer walls.

BACKGROUND OF THE INVENTION

Overflow pans for water heaters have been conventionally made of galvanized steel with bottom and side walls interconnected by a suitable interlocking seam. A nipple of coupling is normally provided through the side wall for connection with a drain to remove water leaking from the heater into the pan. Not only are units of this type unsightly but they are extremely difficult to clean and the seam normally collects dirt which is very difficult to remove. Additionally, the outside of the seam, where the pan rests on the supporting surface, is often uneven and dirt is difficult to remove from this area so that the installation becomes more and more unsightly as time goes on. Additionally, galvanized pans of this type are likely to rust through at concealed areas under the heater, and such rusting is normally not detected until the heater leaks, whereupon water flows from the pan onto the supporting surface rather than through the nipple and drain. Pans of this type are rather expensive to purchase, primarily because of the labor costs involved in their manufacture, and all too often have an unfortunately short life because of rusting.

BRIEF STATEMENT OF THE INVENTION

The invention, in brief, is directed to a plastic water heater overflow pan having a bottom wall adapted to be seated on a supporting surface and receiving the heater, and a continuous side wall including an inner wall and an outer wall, all of the walls preferably being of a homogeneous construction, one with the other. The inner and outer walls are joined at their upper portions and diverge downwardly therefrom in a range of approximately 5° to 15°, and preferably about 10°, with a bottom edge portion of the outer wall substantially coplanar with the outer face of the bottom wall and preferably extending outwardly from the outer face a distance of up to approximately 0.0001 inch when the pan is in a relaxed condition. When the pan is placed on a supporting surface and receives the water heater, the pan flexes slightly so that the outer face of the bottom wall and the bottom edge portion of the outer wall are in snug, close sealed engagement with the supporting surface to provide a neater and more sanitary installation. The pan is preferably of a slightly resilient polystyrene plastic material to permit such flexing. A coupling for connection with a drain opens through the pan and, preferably, through the inner and outer side walls and is in sealed engagement with the inner wall.

It is a primary object of this invention to provide a new and useful overflow pan for a water heater installation.

A more specific object is provision of a new and useful water heater overflow pan including a bottom wall for receiving the bottom of a heater, the bottom wall having an outer face to be seated on a supporting surface, the pan further having a continuous side wall including an inner wall and an outer wall interconnected at their upper portions, the outer wall having a bottom edge to be seated on the supporting surface and the bottom edge being substantially coplanar with the outer face of the bottom wall, and a coupling opening through the pan for connection with a drain. A related object is provision of such a pan in which the bottom edge of the outer wall extends outwardly from the plane of the outer face of the bottom wall a distance of up to approximately 0.0001 inch and the side wall is yieldable to permit both the outer face of the bottom wall and the bottom edge of the outer wall to be seated on the supporting surface. Another related object is provision of the inner and outer walls diverging downwardly and, more particularly, diverging in a range of about 5 to 15° and preferably about 10°. A further related object is provision of the pan being of homogeneous construction of a slightly resilient polystyrene plastic material approximately one-eighth inch thick and the side wall being approximately 2 inches high, with the coupling extending through the inner and outer side walls and in sealed engagement with the inner wall.

DESCRIPTION OF THE ILLUSTRATED EMBODIMENT

Figure 1:
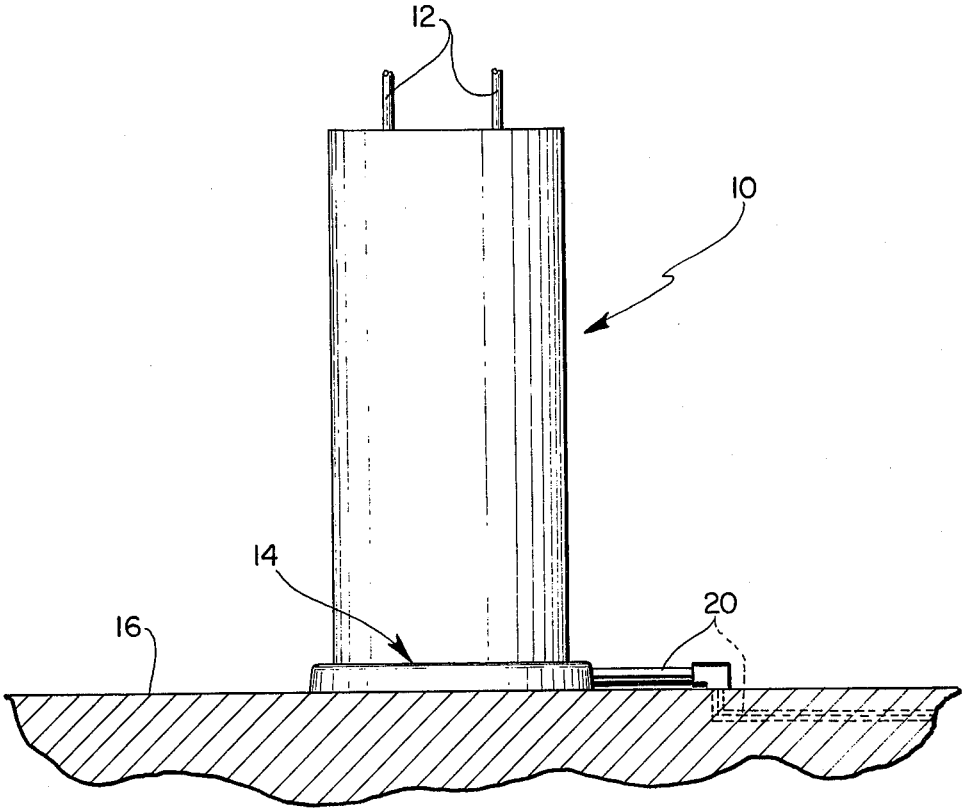
FIG. 1 is a fragmentary, schematic elevational view of a water heater and an overflow pan, with a portion broken away and in section.

Referring first to FIG. 1 of the drawing, an overflow unit as shown includes a typical water heater 10 with the usual cold and hot water connections 12 extending from the top thereof, the bottom of the heater 10 being received in a pan 14 seated on a floor or other suitable supporting surface 16. A coupling, illustrated in the form of a nipple 18 (FIG. 2), extends through the pan 14 and is connected with a suitable drain line 20.

Figure 2:
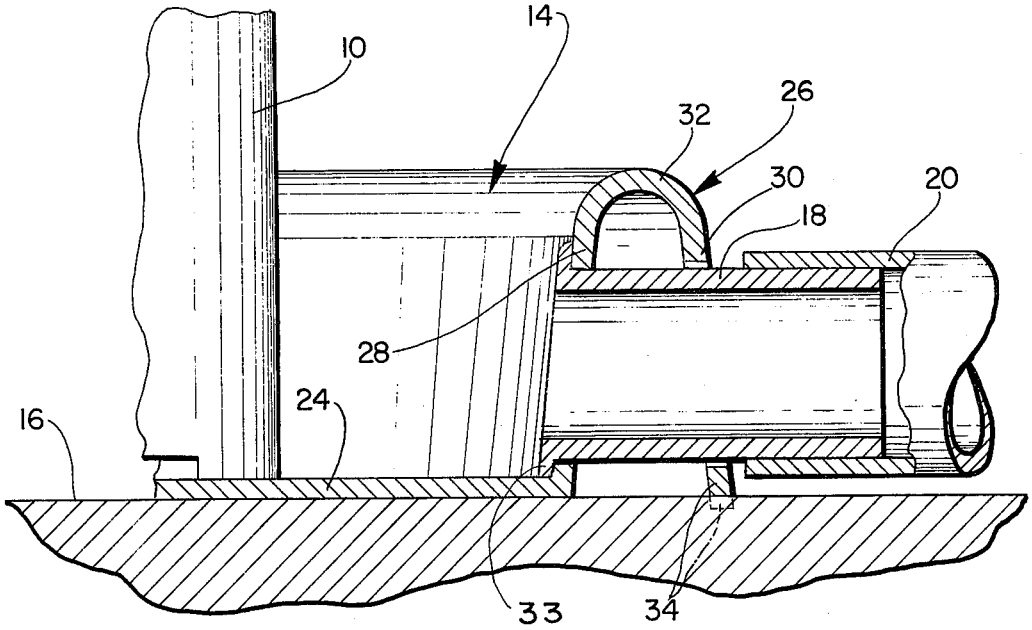
FIG. 2 is an enlarged, fragmentary, schematic elevational view of a lower portion of the structure shown in FIG. 1, with a portion of the overflow pan broken away and in section for clearer illustration.

With reference to FIG. 2, the pan 14 has a bottom wall 24 and a continuous side wall 26 including an inner wall 28 and an outer wall 30, these walls being of a homogeneous construction, one with the other, as by molding or extruding the pan, or the like. The entire pan 14 may be of any suitable thickness, for example one-eighth inch thick, as shown.

As shown in the drawing, side wall 26 is illustrated as annular and the inner and outer walls 28 and 30, respectively, diverge downwardly from a generally semicylindrical, annular connecting portion 32 between the inner and outer walls, and more particularly, diverge at an angle in the range of approximately five to fifteen degrees and preferably about ten degrees.

When in a relaxed condition, as prior to placement of the pan 14 on the supporting surface 16, and prior to placement of the water heater 10 on the bottom wall 24 of the pan, a bottom rim or edge portion 34 of the outer wall 30 extends outwardly very slightly from the outer flat face of the bottom wall 24, for example up to 0.0001 inch, as illustrated, greatly exaggerated by phantom lines in FIG. 2. When the pan is placed on the supporting surface 16 and the water heater 10 is placed in the pan 14, the side wall 26 flexes slightly so that the edge portion 34 is snugly seated on the supporting surface 16 as is the outer face of the bottom wall 24, thus providing a neat and close seam between the outer wall 30 and the supporting surface 16.

Nipple 18 opens through the side wall 26 and more particularly through both the inner wall 28 and the outer wall 30. A flange 33 is integral with the inner end of the nipple 18 and is seated against the inner face of the inner wall 28 and conforms to the configuration of the inner face. A flat face along the bottom of the flange 33 is seated against the upper face of the bottom wall 24. Nipple 18 is snugly seated in an opening in the inner wall and extends freely through an opening in the outer wall 30 to permit flexing of the side wall 26. Flange 33 and the adjacent portion of the nipple 18 are adhesively secured to the bottom wall 24 and the inner wall 28. The nipple 18 is preferably polyvinyl chloride and may have an inside diameter of one inch for receiving a drain line 20 having an inside diameter of one and one-fourth inch and adhesively secured together in typical manner.

The pan 14 is preferably molded of a suitable polystyrene which is slightly yieldable and preferably slightly resilient so that the side wall 26 may flex slightly as its bottom edge portion 34 seats on the supporting surface 16. A suitable plastic material is "fosta tuf-flex" 721 by Foster Grant Co., Inc., Leonminster, Mass., as described in their Bulletin No. I-6-73.

While a cylindrical pan 14 is shown in the drawing, the pan may be generally square or of other shape to conform to the shape of the particular water heater 10. Preferably the side wall 26 is spaced outwardly about one inch or more from the heater to provide a compact unit. Side wall 26 may be of any suitable height, and as illustrated, its height from the supporting surface 16 is about two and three-sixteenths inches so that the height from the inner face of the bottom wall 24 is approximately two and one-sixteenth inches when the walls of the pan are one-eighth inch thick. The unitary, homogenous construction of the pan 14 eliminates the need for unsightly seams and is of smooth and easy to clean construction and may be easily fabricated without sharp edges or corners exposed when the pan is operatively installed on the supporting surface 16.

While this invention has been described and illustrated with reference to a particular embodiments in a particular environment, various changes may be apparent to one skilled in the art and the invention is not therefore to be limited to such embodiments or environment except as set forth in the appended claims.

What is claimed is:

1. A water heater overflow pan comprising, a plastic slightly yieldable pan having a bottom wall for receiving the bottom of the heater, the bottom of said bottom wall having outer face means to be seated on a supporting surface when the heater is received on said bottom wall, said pan further having a continuous side wall including a generally upright inner wall and a generally upright outer wall interconnected at their upper portions, said outer wall having bottom edge means to be seated on the supporting surface and said bottom edge means extending slightly downwardly from said outer face means of said bottom wall to be flexed into firm seated engagement with the supporting surface as said pan yields responsive to the heater being received on said bottom wall, and a coupling opening through said side wall for connection with a drain, said coupling being in sealed engagement with said inner wall and extending freely through said outer wall to permit free relative movement between said coupling and said outer wall as said pan and heater are seated on said supported surface.

2. A pan as set forth in claim 1 in which said bottom edge means of said outer wall extends downwardly from the plane of said outer face means of said bottom wall a distance up to approximately 0.0001 inch.

3. A pan as set forth in claim 1 in which the inner and outer walls diverge from said upper portion.

4. A pan as set forth in claim 3 in which the last said walls diverge in a range of about 5° to 15 degrees.

5. A pan as set forth in claim 3 in which said bottom edge means of said outer wall extends downwardly from the plane of said outer means of said bottom wall a distance up to approximately 0.0001 inch.

6. A pan as set forth in claim 5 in which all said walls are of homogeneous construction, one with the other, and are of a slightly resilient polystyrene and approximately one-eighth inch thick, the inner and outer walls are approximately 2 inches high and diverge approximately 10°, and said coupling extends through said inner and outer walls and is in sealed engagement therewith.

* * * * *